US009481069B2

(12) United States Patent
Chen et al.

(10) Patent No.: US 9,481,069 B2
(45) Date of Patent: Nov. 1, 2016

(54) CHEMICAL MECHANICAL POLISHING APPARATUS AND POLISHING METHOD USING THE SAME

(71) Applicant: TAIWAN SEMICONDUCTOR MANUFACTURING CO., LTD., Hsinchu (TW)

(72) Inventors: Yuan-Hsuan Chen, Tainan (TW); Sheng-Chen Wang, Taichung (TW); Feng-Inn Wu, Taichung (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 257 days.

(21) Appl. No.: 14/073,641

(22) Filed: Nov. 6, 2013

(65) Prior Publication Data

US 2015/0126095 A1 May 7, 2015

(51) Int. Cl.

*B24B 37/24* (2012.01)
*B24B 37/04* (2012.01)
*B24B 37/10* (2012.01)

(52) U.S. Cl.

CPC ..... *B24B 37/046* (2013.01); *B24B 37/105* (2013.01); *B24B 37/24* (2013.01)

(58) Field of Classification Search

CPC ..... B24B 37/04; B24B 37/24; B24B 37/046; B24B 37/105

USPC ..... 451/41, 287, 288, 289, 290, 526–539

See application file for complete search history.

(56) References Cited

U.S. PATENT DOCUMENTS

| | | | | |
|---|---|---|---|---|
| 6,244,941 | B1 * | 6/2001 | Bowman | B24B 37/11 451/287 |
| 6,261,958 | B1 * | 7/2001 | Crevasse | B24B 45/00 438/692 |
| 8,845,398 | B2 * | 9/2014 | Chen | B24B 37/22 451/285 |
| 2002/0098785 | A1 * | 7/2002 | Doan | B24B 37/11 451/285 |

* cited by examiner

*Primary Examiner* — Robert Rose

(74) *Attorney, Agent, or Firm* — McDermott Will & Emery LLP

(57) ABSTRACT

A chemical mechanical polishing apparatus includes a platen, a polishing head, a magnetizable polishing pad, and an electromagnetic component. The magnetizable polishing pad is disposed between the polishing head and the platen. The electromagnetic component is configured for fastening the magnetizable polishing pad on the platen.

20 Claims, 5 Drawing Sheets

CHEMICAL MECHANICAL POLISHING APPARATUS AND POLISHING METHOD USING THE SAME

BACKGROUND

1. Technical Field

The present disclosure relates to a chemical mechanical polishing (CMP) apparatus.

2. Description of Related Art

During the manufacturing process of a semiconductor device, a wafer for forming the semiconductor device can be polished using a chemical mechanical polishing (CMP) apparatus to form a flat surface. In general, the polishing pad of the chemical mechanical polishing apparatus can be pasted on the platen using an adhesive, such that the wafer can be disposed on the polishing pad to be polished. However, bubbles may be trapped between the polishing pad and the platen if the pasting process of the polishing pad is failed. The polishing pad may be not so flat due to the trapped bubbles, which may cause the damages in the wafer when the wafer is polished. In addition, as consumables, the polishing pad can be replaced at regular intervals. The bubble issue may appear every time, such that the maintaining period may be longer, resulting in a low efficiency of the manufacturing process.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and apparatus are schematically depicted in order to simplify the drawings.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present disclosure. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

Figure 1:
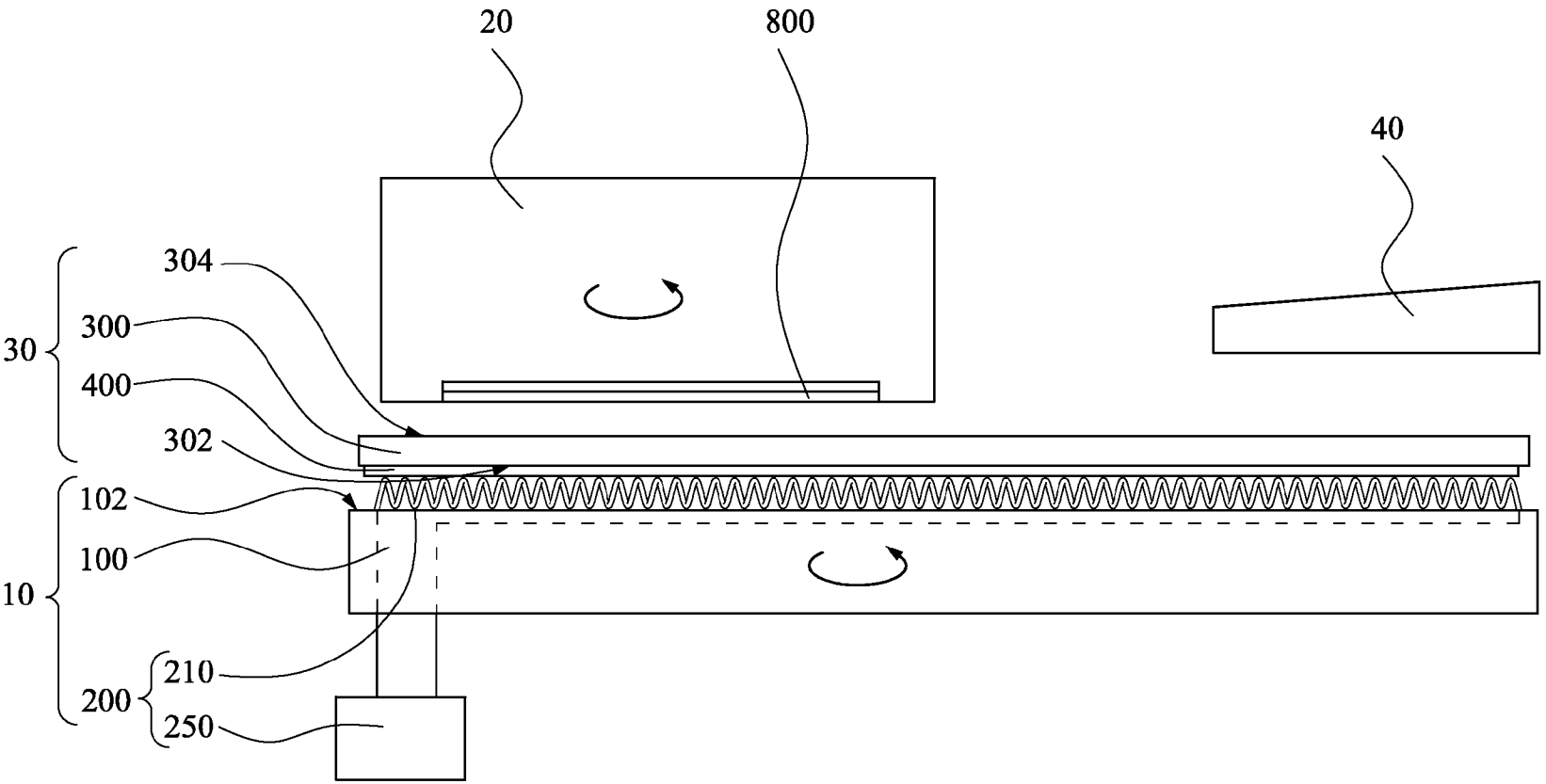
FIG. 1 is a side view of the chemical mechanical polishing apparatus and a wafer according to one or various embodiments of the present disclosure.

FIG. 1 is a side view of the chemical mechanical polishing apparatus and a wafer 800 according to one or various embodiments of the present disclosure. The chemical mechanical polishing apparatus includes a platen 100, a polishing head 20, a magnetizable polishing pad 30, and an electromagnetic component 200. The magnetizable polishing pad 30 is disposed between the polishing head 20 and the platen 100. The electromagnetic component 200 is configured for fastening the magnetizable polishing pad 30 on the platen 100.

A magnetic field can be generated in the electromagnetic component 200. The magnetizable polishing pad 30 can be attracted by the magnetic field, such that the magnetizable polishing pad 30 can be fastened on the platen 100 via the electromagnetic component 200. If bubbles are trapped between the magnetizable polishing pad 30 and the platen 100, the electromagnetic component 200 may stop generating the magnetic field, such that the magnetizable polishing pad 30 can be released from the platen 100. In this way, the bubble can be removed easily. After that, the electromagnetic component 200 can apply the current to fasten the magnetizable polishing pad 30 on the platen 100 again.

In this embodiment, the magnetizable polishing pad 300 may include a polishing pad 300 and a plurality of magnetizable materials 400. The magnetizable materials 400 are disposed on a surface 302 of the polishing pad 300 facing the platen 100. Since the magnetizable materials 400 can be attracted by the magnetic field generated from the electromagnetic component 200, the polishing pad 300 can be fastened on the platen 100 via the magnetizable materials 400.

The polishing pad 300 further has a polishing surface 304 disposed opposite to the surface 302. A wafer 800 can be held by the polishing head 20 and disposed on the polishing surface 304. Therefore, the wafer 800 can be polished when the polishing head 100 and the polishing pad 300 are rotating, respectively.

In this embodiment, the electromagnetic component 200 may include a plurality of coils 210 and a power supply 250. The coils 210 are disposed on a surface 102 of the platen 100 facing the magnetizable polishing pad 30. The power supply 250 is electrically connected to the coils 210 for applying current to the coils 210, respectively. Therefore, the power supply 250 can apply current to the coils 210 to generate magnetic fields. In some embodiments, the power supply 250 can apply current to the coils 210 in sequence. However, the scope of the claimed disclosure should not be limited in this respect.

Figure 2:
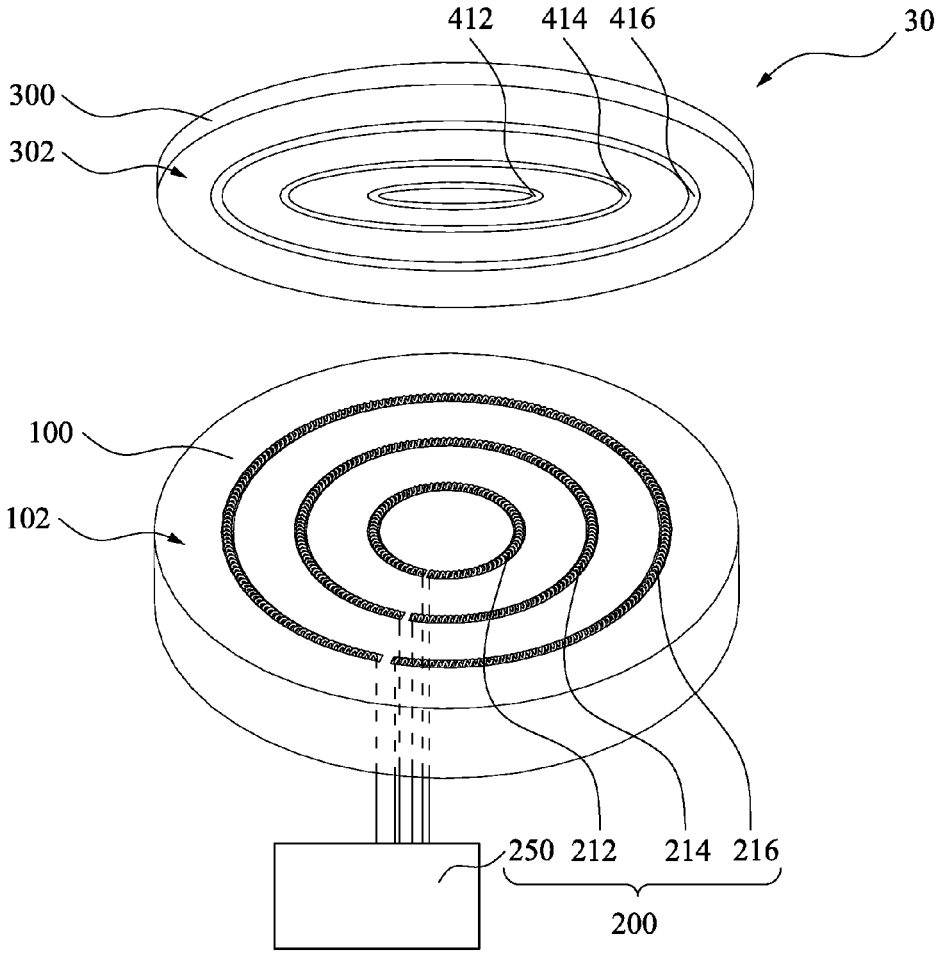
FIG. 2 is a schematic view of a magnetizable polishing pad, an electromagnetic component, and a platen of FIG. 1 according to a first embodiment of the present disclosure.

Reference is made to FIG. 2 which is a schematic view of the magnetizable polishing pad 30, the electromagnetic component 200, and the platen 100 of FIG. 1 according to a first embodiment of the present disclosure. To show the detail clarified, the surface 302 of the magnetizable polishing pad 30 and the surface 102 of the platen 100 are both shown in FIG. 2. In this embodiment, the magnetizable materials 412, 414, and 416 can form a magnetic pattern on the surface 302 of the polishing pad 300. In other words, the magnetizable materials 412, 414, and 416 can expose at least a portion of the surface 302 of the polishing pad 300. In addition, the coils 212, 214, and 216 can form an electromagnetic pattern on the surface 102 of the platen 100. Also, the coils 212, 214, and 216 can expose at least a portion of the surface 102 of the platen 100. A shape of the magnetic pattern can be symmetric to a shape of the electromagnetic pattern.

Taking FIG. 2 as an example, the electromagnetic pattern includes a plurality of concentric circles. Furthermore, the magnetic pattern includes a plurality of concentric circles. As mentioned above, the shape of the magnetic pattern can be symmetric to a shape of the electromagnetic pattern, i.e., a position of the magnetizable materials 412, 414, and 416 can be complimented to a position of the coils 212, 214, and 216 when the polishing pad 300 is fastened on the platen 100. In greater detail, as shown in FIG. 2, the shape of the magnetizable materials 412 can be symmetric to that of the coil 212, and the position of the magnetizable materials 412 can be complimented to that of the coil 212. The shape of the magnetizable materials 414 can be symmetric to that of the coil 214, and the position of the magnetizable materials 414 can be complimented to that of the coil 214. The shape of the magnetizable materials 416 can be symmetric to that of the coil 216, and the position of the magnetizable materials 416 can be complimented to that of the coil 216. Therefore, the magnetizable materials 412, 414, and 416 can be attracted by the magnetic fields generated from the coils 212, 214, and 216, respectively, when the power supply 250 applies current to the coils 212, 214, and 216. In this way, the position of the polishing pad 300 can be aligned on the platen 100 when the polishing pad 300 is fastened on the platen 100. It should be noticed that the numbers of the concentric circles of the electromagnetic pattern and the magnetic pattern are illustrative, and should not limit the claimed scope. A person having ordinary skill in the art may select proper numbers of the concentric circles of the electromagnetic pattern and the magnetic pattern according to actual requirements.

Figure 3:
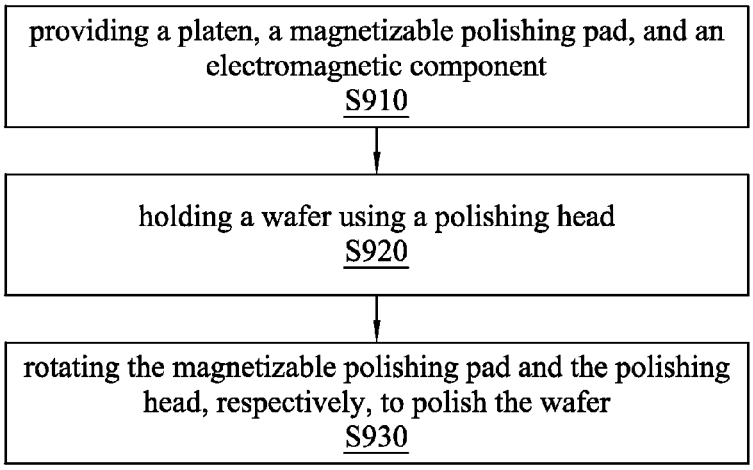
FIG. 3 is a flow chart of a method for polishing a wafer using the chemical mechanical polishing apparatus of FIG. 1 according to one embodiment of the present disclosure.

The following paragraphs provide detailed explanations with respect to how to polish the wafer 800 using the chemical mechanical polishing apparatus of FIG. 1. FIG. 3 is a flow chart of a method for polishing the wafer 800 using the chemical mechanical polishing apparatus of FIG. 1 according to one embodiment of the present disclosure. Reference is made both to FIG. 1 and FIG. 3. As shown in act S910, the platen 100, the magnetizable polishing pad 30, and the electromagnetic component 200 of FIG. 1 are provided. As shown in act S920, the wafer 800 is held using the polishing head 20. Substantially, as shown in act S930, the magnetizable polishing pad 30 and the polishing head 20 are rotated, respectively, to polish the wafer 800. It should be noticed that the flow chart of FIG. 3 shows exemplary acts, but they are not necessarily performed in the order shown. Acts may be added, replaced, changed order, and/or eliminated as appropriate, in accordance with the spirit and scope of disclosed embodiments. Therefore, the wafer can be polished using the chemical mechanical polishing apparatus of FIG. 1.

In one or more embodiment, the method can further include act:

applying current, DC current for example, to a plurality of the coils 210 disposed on the surface 102 of the platen 100 facing the polishing pad 300 in sequence to adhere the polishing pad 300 via the magnetizable materials 400. Taking FIG. 2 for example, the current can be applied to the coils 212, 214, and 216 in sequence to fasten the polishing pad 300 via the magnetizable materials 412, 414, and 416. In one or more embodiments, the current can be applied by the power supply 250. Therefore, bubbles between the polishing pad 300 and the platen 100 can be removed if the bubbles exist.

Since the current is applied to the coils 212, 214, and 216 in sequence, the magnetic fields generated from the coils 212, 214, and 216 can attract the magnetizable materials 412, 414, and 416 in sequence. For example, the current can be applied to the coils disposed at the center of the surface 102 to the edge of the surface 102 in sequence. The power supply 250 can apply the current to the coil 212 first, and the magnetic field is generated from the coil 212. The magnetizable materials 412 can be attracted by the magnetic field, such that the polishing pad 300 is fastened on the platen 100 and its position on the platen 100 also can be aligned.

Subsequently, the power supply 250 can start to apply the current to the coil 214 while maintain the current supply of the coil 212, such that the coil 214 starts to generate another magnetic field. The magnetizable materials 414 can be attracted by the magnetic field generated from the coil 214. In other words, the polishing pad 300 can be fastened on the platen 100 via the attractions between the magnetizable materials 412 and the coil 212, and between the magnetizable materials 414 and the coil 214.

Next, the power supply 250 can start to apply the current to the coil 216 while maintain the current supplies of the coils 212 and 214, such that the coil 216 start to generate yet another magnetic field. The magnetizable materials 416 can be attracted by the magnetic field generated from the coil 216. In other words, the polishing pad 300 can be fastened on the platen 100 via the attractions between the magnetizable materials 412 and the coil 212, between the magnetizable materials 414 and the coil 214, and between the magnetizable materials 416 and the coil 216.

Following the method mentioned above, the polishing pad 300 can be fastened on the platen 100 from the center to the edge of the surface 302. Therefore, although some air may be trapped between the polishing pad 300 and the platen 100 when the power supply 250 is turned off, the polishing pad 300 can squeeze the air out during the fastening process. In addition, if there are still some bubbles trapped between the polishing pad 300 and the platen 100 when the polishing pad 300 is fastened on the platen 100, the power supply 250 can be turned off to release the bubbles. Therefore, the power supply 250 can apply the current following the method mentioned above to fasten the polishing pad 300 on the platen 100 again.

Reference is made back to FIG. 1. In this embodiment, the magnetizable materials 400 can be paramagnetic materials or ferromagnetic materials. For example, the magnetizable materials 400 can be made of alkali metal, rare earth metal, iron, cobalt, nickel, gadolinium, dysprosium, holmium, or any combination thereof. It should be noticed that the material of the magnetizable materials 400 are illustrative, and should not limit the claimed scope. A person having ordinary skill in the art may select a proper material for the magnetizable materials 400 according to actual requirements.

The chemical mechanical polishing apparatus can further include a slurry delivery arm 40 disposed above the magnetizable polishing pad 30 for providing slurries onto the magnetizable polishing pad 30. During the polishing process of the chemical mechanical polishing apparatus, slurries can be provided to the polishing surface 302 of the polishing pad 300. Therefore, materials can be removed from the wafer 800 through a chemical activity with the slurries and a mechanical activity with the polishing pad 300.

Structurally, to describe from another view, the chemical mechanical polishing apparatus includes an electromagnetic table 10, the polishing pad 300, and a plurality of magnetizable materials 400. The electromagnetic table 10 has an electromagnetic pattern. The polishing pad 300 is detachably disposed on the electromagnetic table 10 and covering the electromagnetic pattern of the electromagnetic table 10. The magnetizable materials 400 are disposed on a surface 302 of the polishing pad 300 facing the electromagnetic table 10.

According to some embodiments, the electromagnetic table 10 may include the platen 100, a plurality of the coils 210, and the power supply 250. The platen 100 has the surface 102 facing the polishing pad 300. The coils 210 can be disposed on the surface 102 to form the electromagnetic pattern (see FIG. 2). The power supply 240 can be electrically connected to the coils 210 for applying current to the coils 210, respectively.

According to some embodiments, the polishing pad 300 can be fastened on the platen 100 when the power supply 250 applies current to the coils 210.

According to some embodiments, the chemical mechanical polishing apparatus may further include the slurry delivery arm 40. A portion of the polishing pad 300 can be disposed between the slurry delivery arm 40 and the electromagnetic table 10.

It is understood that the embodiment of the chemical mechanical polishing apparatus mentioned above is provided merely as examples and are not intended to be limiting. The chemical mechanical polishing apparatus may have different configurations consistent with the spirit of the present disclosure in alternative embodiments depending on design requirements and manufacturing concerns.

Figure 4A:
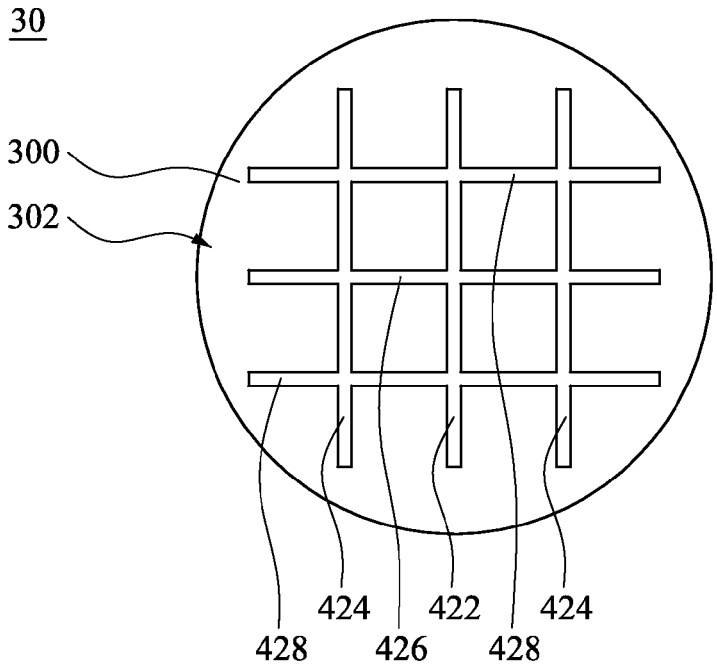
FIG. 4A is a bottom view of the magnetizable polishing pad of FIG. 1 according to a second embodiment of the present disclosure.
Figure 4B:
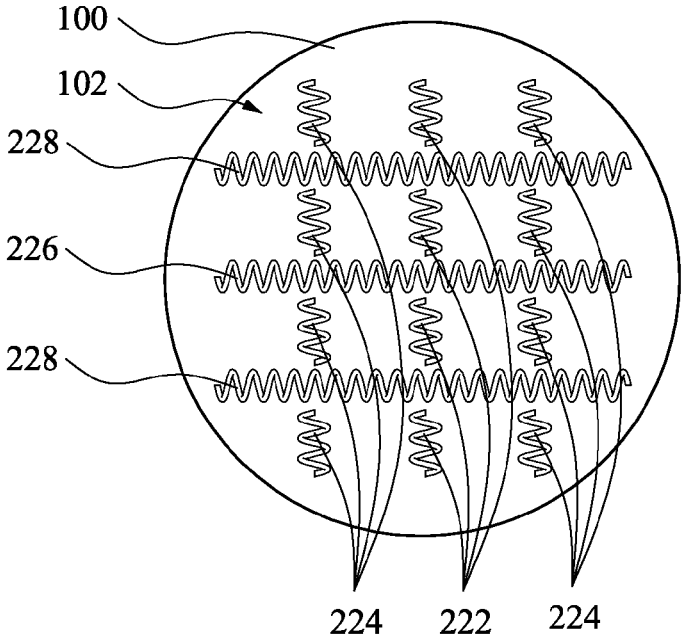
FIG. 4B is a top view of the platen of FIG. 1 according to the second embodiment.

FIG. 4A is a bottom view of the magnetizable polishing pad 30 of FIG. 1 according to a second embodiment of the present disclosure, and FIG. 4B is a top view of the platen 100 of FIG. 1 according to the second embodiment. Reference is made both to FIG. 4A and FIG. 4B. In this embodiment, the shapes of the magnetic pattern and the electromagnetic pattern can be matrixes. In greater detail, the chemical mechanical polishing apparatus can include magnetizable materials 422, 424, 426, and 428. The magnetizable materials 422 and 424 can be crossover with the magnetizable materials 426, and 428 to form the matrix. In addition, the chemical mechanical polishing apparatus can include coils 222, 224, 226, and 228. The coils 222 and 224 can be substantially disposed perpendicular to the coils 226 and 228 to form the matrix.

To fasten the magnetizable polishing pad 30 on the plate 100, the power supply 250 (see FIG. 1) can apply current to the coils 222 and 226 first. Magnetic fields can be generated from the coils 222 and 226, and the magnetizable materials 422 and 426 can be attracted to the coils 222 and 226, respectively. In this way, the position of the polishing pad 300 can be aligned on the platen 100.

Subsequently, the power supply 250 can start to apply the current to the coils 224 and 228 while maintain the current supplies of the coils 222 and 226, such that the coils 224 and 228 start to generate another magnetic fields. The magnetizable materials 424 and 428 can be attracted by the magnetic fields generated from the coils 224 and 228, respectively. Therefore, the polishing pad 300 can be fastened on the platen 100 via the attractions between the magnetizable materials 422, 424, 426, 428 and the coils 222, 224, 226, 228.

Following the method mentioned above, the polishing pad 300 can be fastened on the platen 100 from the center to the edge of the surface 302. Therefore, the polishing pad 300 can squeeze the air out of the space between the polishing pad 300 and the platen 100 during the fastening process.

It should be noticed that the number of the coils is illustrative, and should not limit the claimed scope. A person having ordinary skill in the art may select a proper number of the coils according to actual requirements. Other features of the magnetizable polishing pad 30 and the platen 100 are the same as those of the magnetizable polishing pad 30 and the platen 100 shown in FIG. 2, and therefore, a description in this regard will not be provided hereinafter.

Figure 5A:
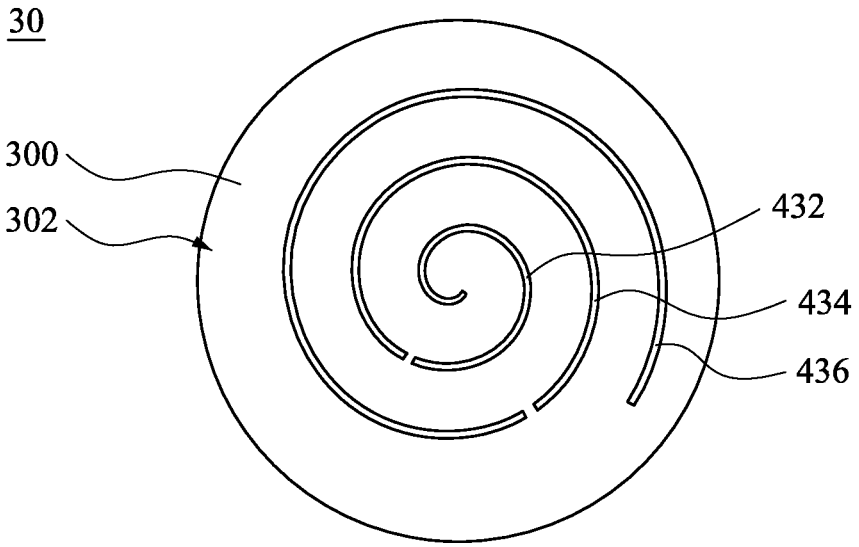
FIG. 5A is a bottom view of the magnetizable polishing pad of FIG. 1 according to a third embodiment of the present disclosure.
Figure 5B:
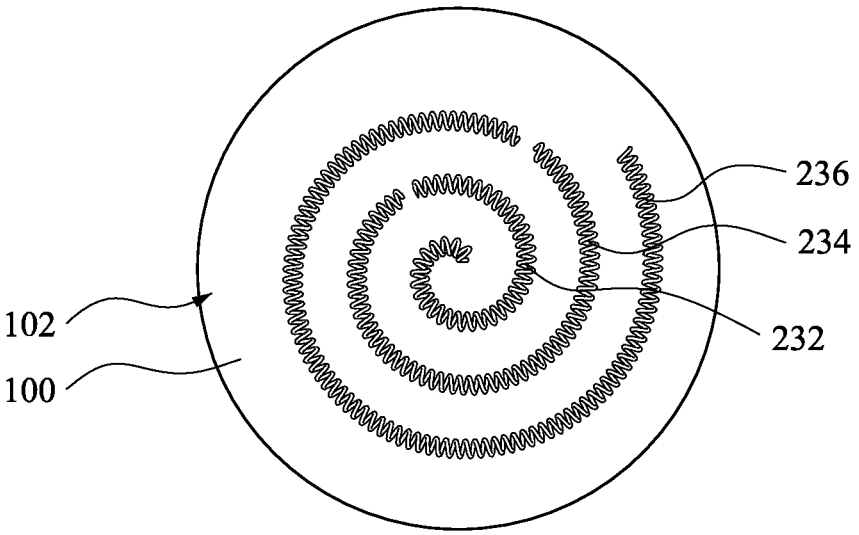
FIG. 5B is a top view of the platen of FIG. 1 according to the third embodiment.

FIG. 5A is a bottom view of the magnetizable polishing pad 30 of FIG. 1 according to a third embodiment of the present disclosure, and FIG. 5B is a top view of the platen 100 of FIG. 1 according to the third embodiment. Reference is made both to FIG. 5A and FIG. 5B. In this embodiment, the shapes of the magnetic pattern and the electromagnetic pattern can be spirals. In greater detail, the chemical mechanical polishing apparatus can include magnetizable materials 432, 434, and 436. In addition, the chemical mechanical polishing apparatus can include coils 232, 234, and 236. It should be noticed that the number of the coils is illustrative, and should not limit the claimed scope. A person having ordinary skill in the art may select a proper number of the coils according to actual requirements.

To fasten the magnetizable polishing pad 30 on the plate 100, the power supply 250 (see FIG. 1) can apply current to the coil 232 first. Magnetic fields can be generated from the coil 232, and the magnetizable materials 432 can be attracted to the coil 232. In this way, the position of the polishing pad 300 can be aligned on the platen 100.

Subsequently, the power supply 250 can start to apply the current to the coil 234 while maintain the current supplies of the coil 222, and then start to apply the current to the coil 236 while maintain the current supplies of the coils 232 and 234. Therefore, the magnetizable materials 434 and 436 can be attracted by the magnetic fields generated from the coils 234 and 234, respectively. In this way, the polishing pad 300 can be fastened on the platen 100 via the attractions between the magnetizable materials 432, 434, 436 and the coils 232, 234, 236.

Following the method mentioned above, the polishing pad 300 can be fastened on the platen 100 from the center to the edge of the surface 302. Therefore, the polishing pad 300 can squeeze the air out during the fastening process. Other features of the magnetizable polishing pad 30 and the platen 100 are the same as those of the magnetizable polishing pad 30 and the platen 100 shown in FIG. 2, and therefore, a description in this regard will not be provided hereinafter.

Figure 6A:
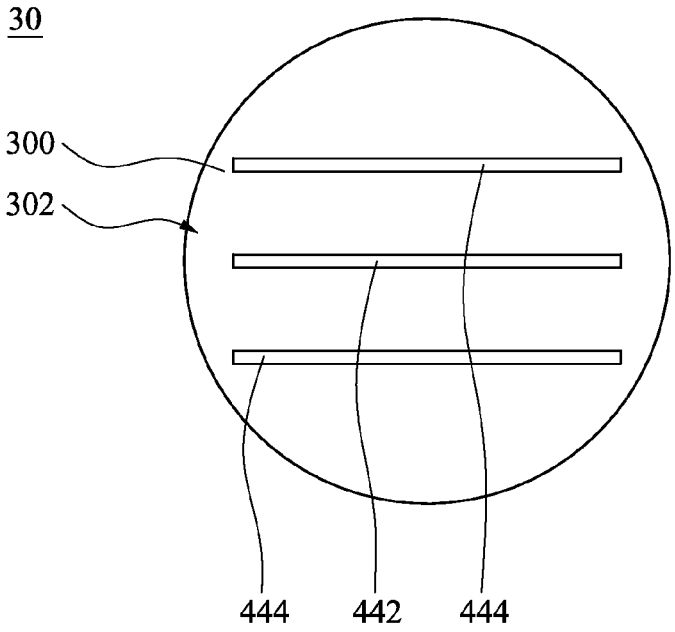
FIG. 6A is a bottom view of the magnetizable polishing pad of FIG. 1 according to a fourth embodiment of the present disclosure.
Figure 6B:
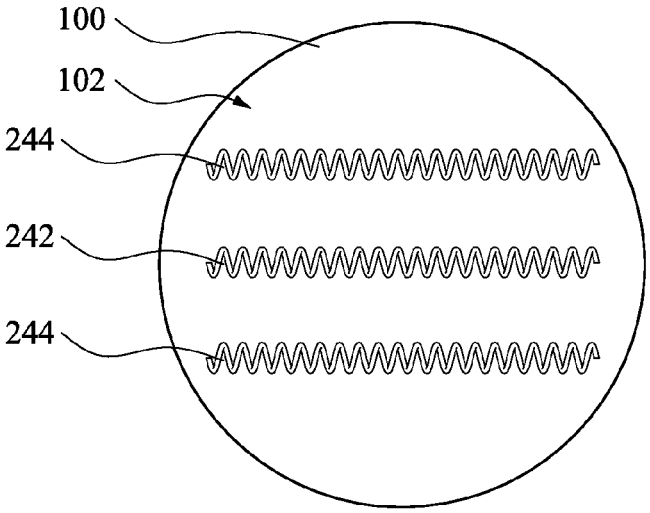
FIG. 6B is a top view of the platen of FIG. 1 according to the fourth embodiment.

FIG. 6A is a bottom view of the magnetizable polishing pad 30 of FIG. 1 according to a fourth embodiment of the present disclosure, and FIG. 6B is a top view of the platen 100 of FIG. 1 according to the fourth embodiment. Reference is made both to FIG. 6A and FIG. 6B. In this embodiment, the shapes of the magnetic pattern and the electromagnetic pattern can be straight lines. In greater detail, the chemical mechanical polishing apparatus can include magnetizable materials 442, and 444. In addition, the chemical mechanical polishing apparatus can include coils 242, and 244. It should be noticed that the number of the coils is illustrative, and should not limit the claimed scope. A person having ordinary skill in the art may select a proper number of the coils according to actual requirements.

To fasten the magnetizable polishing pad 30 on the plate 100, the power supply 250 (see FIG. 1) can apply the current to the coil 232 first. Magnetic fields can be generated from the coil 242, and the magnetizable materials 442 can be attracted to the coil 242. In this way, the position of the polishing pad 300 can be aligned on the platen 100.

Subsequently, the power supply 250 can start to apply the current to the coil 244 while maintain the current supplies of the coil 242. Therefore, the magnetizable materials 444 can be attracted by the magnetic fields generated from the coil 234. In this way, the polishing pad 300 can be fastened on the platen 100 via the attractions between the magnetizable materials 442, 444 and the coils 242, 244.

Following the method mentioned above, the polishing pad 300 can be fastened on the platen 100 from the center to the edge of the surface 302. Therefore, the polishing pad 300 can squeeze the air out during the fastening process. Other features of the magnetizable polishing pad 30 and the platen 100 are the same as those of the magnetizable polishing pad 30 and the platen 100 shown in FIG. 2, and therefore, a description in this regard will not be provided hereinafter.

It should be understood the shapes of the magnetic pattern and the electromagnetic patter mentioned above are illustrative, and should not limit the claimed scope. A person having ordinary skill in the art may design proper shapes of the magnetic pattern and the electromagnetic patter according to actual requirements.

According to the embodiments mentioned above, one form of the present disclosure provides the chemical mechanical polishing apparatus including the platen, the polishing head, the magnetizable polishing pad, and an electromagnetic component. The magnetizable polishing pad is disposed between the polishing head and the platen. The electromagnetic component is configured for fastening the magnetizable polishing pad 30 on the platen.

Another form of the present disclosure provides the chemical mechanical polishing apparatus including the electromagnetic table, the polishing pad, and a plurality of the magnetizable materials. The electromagnetic table has an electromagnetic pattern. The polishing pad is detachably disposed on the electromagnetic table and covering the electromagnetic pattern of the electromagnetic table. The magnetizable materials are disposed on the surface of the polishing pad facing the electromagnetic table.

Yet another form of the present disclosure provides the method for polishing the wafer using the chemical mechanical polishing apparatus. The method includes the following acts of: (The acts are not recited in the sequence in which the acts are performed. That is, unless the sequence of the acts is expressly indicated, the sequence of the acts is interchangeable, and all or part of the acts may be simultaneously, partially simultaneously, or sequentially performed.)

The platen, the magnetizable polishing pad, and the electromagnetic component are provided. The magnetizable polishing pad is disposed between the polishing head and the platen, and the electromagnetic component is for fastening the magnetizable polishing pad on the platen. The wafer is held using the polishing head. The magnetizable polishing pad and the polishing head are rotated, respectively, to polish the wafer.

Although the embodiments have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods, and steps described in the specification. A person having ordinary skill in the art can readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A chemical mechanical polishing apparatus, comprising:
- a platen;
- a polishing head;
- a magnetizable polishing pad disposed between the polishing head and the platen; and
- an electromagnetic component comprising:
  - a plurality of coils disposed on a surface of the platen facing the magnetizable polishing pad;
  - a power supply; and
  - a plurality of electrical wires respectively electrically connecting the power supply to the coils such that the coils are individually controllable, wherein the electromagnetic component is configured for fastening the magnetizable polishing pad on the platen by a plurality of magnetic fields generated by the coils.

2. The chemical mechanical polishing apparatus of claim 1, wherein the magnetizable polishing pad comprises:
- a polishing pad; and
- a plurality of magnetizable materials disposed on a surface of the polishing pad facing the platen.

3. The chemical mechanical polishing apparatus of claim 1, wherein the magnetizable materials form a magnetic pattern on the surface of the polishing pad, and the coils form an electromagnetic pattern on the surface of the platen, a shape of the magnetic pattern is symmetric to a shape of the electromagnetic pattern.

4. The chemical mechanical polishing apparatus of claim 1, wherein the coils form an electromagnetic pattern on the surface of the platen, and the electromagnetic pattern comprises a plurality of concentric circles.

5. The chemical mechanical polishing apparatus of claim 2, wherein the magnetizable materials form a magnetic pattern on the surface of the polishing pad, and the magnetic pattern comprises a plurality of concentric circles.

6. The chemical mechanical polishing apparatus of claim 2, wherein the magnetizable materials form a magnetic pattern on the surface of the polishing pad, and the shape of the magnetic pattern is a matrix or a plurality of spirals.

7. The chemical mechanical polishing apparatus of claim 1, wherein the magnetizable materials are paramagnetic materials or ferromagnetic materials.

8. The chemical mechanical polishing apparatus of claim 1, further comprising:
- a slurry delivery arm disposed above the magnetizable polishing pad for providing slurries onto the magnetizable polishing pad.

9. A chemical mechanical polishing apparatus, comprising:
- an electromagnetic table having an electromagnetic pattern comprising a plurality of coils formed on a surface of the electromagnetic table;

a polishing pad detachably disposed on the electromagnetic table and covering the electromagnetic pattern of the electromagnetic table;

a plurality of magnetizable materials disposed on a surface of the polishing pad facing the electromagnetic table;

a power supply; and a plurality of electrical wires respectively electrically connecting the power supply to the coils, such that the coils are individually controllable, wherein the coils comprise a first coil arranged at a center of the electromagnetic table, and a second coil arranged at an edge of the electromagnetic table.

10. The chemical mechanical polishing apparatus of claim 9, wherein the electromagnetic table comprises:

a platen having the surface of the electromagnetic table facing the polishing pad, and the coils are disposed in the surface of the platen to form the electromagnetic pattern.

11. The chemical mechanical polishing apparatus of claim 10, wherein the polishing pad is fastened on the platen when the power supply applies current to the coils.

12. The chemical mechanical polishing apparatus of claim 11, wherein a position of the magnetizable materials is complimented to a position of the coils when the polishing pad is fastened on the electromagnetic table.

13. The chemical mechanical polishing apparatus of claim 9, wherein the magnetizable materials expose at least a portion of the surface of the polishing pad.

14. The chemical mechanical polishing apparatus of claim 9, wherein the magnetizable materials are made of alkali metal, rare earth metal, iron, cobalt, nickel, gadolinium, dysprosium, holmium, or any combination thereof.

15. The chemical mechanical polishing apparatus of claim 9, further comprising:

a slurry delivery arm, wherein a portion of the polishing pad is disposed between the slurry delivery arm and the electromagnetic table.

16. A method for polishing a wafer using a chemical mechanical polishing apparatus, comprising:

providing a platen, a magnetizable polishing pad, and an electromagnetic component, wherein the magnetizable polishing pad is disposed between a polishing head and the platen, the electromagnetic component is for fastening the magnetizable polishing pad on the platen, and the magnetizable polishing pad comprises a polishing pad and a plurality of magnetizable materials disposed on a surface of the polishing pad facing the platen;

applying current to a plurality of coils disposed on a surface of the platen facing the polishing pad in sequence to adhere the polishing pad via the magnetizable materials;

holding the wafer using the polishing head; and rotating the magnetizable polishing pad and the polishing head, respectively, to polish the wafer.

17. The method of claim 16, wherein applying current to the coils comprises:

applying the current to the coils disposed at the center of the surface to the edge of the surface in sequence.

18. The method of claim 16, wherein the magnetizable materials are paramagnetic materials or ferromagnetic materials.

19. The method of claim 16, further comprising:

providing slurries onto the magnetizable polishing pad.

20. The chemical mechanical polishing apparatus of claim 1, wherein the coils comprise a first coil arranged at a center of the platen, and a second coil arranged at an edge of the platen, wherein the magnetic fields comprise a first magnetic field generated by the first coil, and a second magnetic field generated by the first coil and the second coil.

* * * * *